US009080538B2

(12) United States Patent
Kuschel

(10) Patent No.: US 9,080,538 B2
(45) Date of Patent: Jul. 14, 2015

(54) INJECTOR ASSEMBLY FOR AN INJECTION VALVE

(75) Inventor: Alexander Kuschel, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 842 days.

(21) Appl. No.: 13/147,552

(22) PCT Filed: Jan. 25, 2010

(86) PCT No.: PCT/EP2010/050791
§ 371 (c)(1),
(2), (4) Date: Aug. 2, 2011

(87) PCT Pub. No.: WO2010/089217
PCT Pub. Date: Aug. 12, 2010

(65) Prior Publication Data

US 2011/0284667 A1 Nov. 24, 2011

(30) Foreign Application Priority Data

Feb. 3, 2009 (DE) ..... 10 2009 007 213

(51) Int. Cl.

| | |
|---|---|
| ***F02M 59/00*** | (2006.01) |
| ***F02M 61/00*** | (2006.01) |
| ***F02M 47/02*** | (2006.01) |
| ***F02M 63/00*** | (2006.01) |

(52) U.S. Cl.
CPC ..... *F02M 47/027* (2013.01); *F02M 63/0026* (2013.01); *F02M 2200/16* (2013.01); *F02M 2200/21* (2013.01)

(58) Field of Classification Search
CPC ..... B05B 1/30; B05B 1/34; B05B 1/3006; B05B 1/3013; B05B 1/302; F02M 63/00; F02M 39/00; F02M 41/00; F02M 43/00; F02M 47/00; F02M 55/00; F02M 59/00; F02M 61/06; F02M 45/00; F02M 61/20; F02M 51/00
USPC ..... 239/533.2, 533.1, 533.3, 533.5, 533.9, 239/569, 570, 583, 585.1, 585.3, 585.4, 239/585.5; 123/299, 446, 447, 467, 468
See application file for complete search history.

(56) References Cited

U.S. PATENT DOCUMENTS

| | | | | |
|---|---|---|---|---|
| 2003/0019955 | A1 * | 1/2003 | Schraudner et al. | 239/533.2 |
| 2003/0052198 | A1 * | 3/2003 | Tappolet et al. | 239/533.3 |
| 2003/0168526 | A1 * | 9/2003 | Kienzler et al. | 239/533.2 |
| 2005/0087624 | A1 * | 4/2005 | Neumaier | 239/533.2 |

FOREIGN PATENT DOCUMENTS

| | | | | |
|---|---|---|---|---|
| DE | 10019810 | A1 | 1/2002 | F02M 47/02 |
| DE | 10220931 | C1 | 11/2003 | F02M 47/00 |
| EP | 0199632 | A1 | 10/1986 | F02M 47/02 |
| WO | 2010/023133 | A1 | 3/2010 | F02M 55/00 |
| WO | 2010/089217 | A1 | 8/2010 | F02M 47/02 |

OTHER PUBLICATIONS

International Search Report and Written Opinion for Application No. PCT/EP2010/050791 (11 pages), Jun. 29, 2010.

* cited by examiner

*Primary Examiner* — Justin Jonaitis
(74) *Attorney, Agent, or Firm* — Slayden Grubert Beard PLLC

(57) ABSTRACT

A jet needle has a front face turned away from an injection opening. An injector assembly has a chamber within the body adjoining the front face, a throttle module arranged in the chamber having a fluid supply chamber being hydraulically coupled to the fluid inlet, a control space hydraulically coupled to the fluid supply chamber via an inlet throttle, and a valve chamber hydraulically coupled to the control space via an outlet throttle for accommodating a valve that is designed to lead fluid into a fluid return line arranged in a control module. There are precisely two sealing edges designed between the throttle module and the injector body and/or the control module by which additional hydraulic couplings of the fluid supply chamber to the control space and the valve chamber are cut off. A third sealing edge is designed between the injector body and the control module.

15 Claims, 2 Drawing Sheets

INJECTOR ASSEMBLY FOR AN INJECTION VALVE

CROSS-REFERENCE TO RELATED APPLICATIONS

This application is a U.S. National Stage Application of International Application No. PCT/EP2010/050791 filed Jan. 25, 2010, which designates the United States of America, and claims priority to German Application No. 10 2009 007 213.6 filed Feb. 3, 2009, the contents of which are hereby incorporated by reference in their entirety.

TECHNICAL FIELD

The invention relates to an injector assembly for an injection valve, having an injector body, having a nozzle needle which is arranged in a recess of the injector body in such a way that it prevents a fluid flow through at least one injection opening in a closed position and releases a fluid flow through the injection opening in an open position. Furthermore, the invention relates to an injection valve having an injector assembly and an actuator unit, the injector assembly and the actuator unit being coupled to one another.

BACKGROUND

More and more stringent legal directives with regard to the permissible pollutant emissions of internal combustion engines which are arranged in motor vehicles make it necessary to perform diverse measures, by which the pollutant emissions are lowered. A starting point here is to lower the pollutant emissions which are produced by the internal combustion engine. The formation of soot is greatly dependent on the preparation of the air/fuel mixture in the respective cylinder of the internal combustion engine.

Correspondingly satisfactory mixture preparation can be achieved if the fuel is metered in under very high pressure. In the case of diesel internal combustion engines, the fuel pressures are up to 2000 bar. High pressures of this type place high requirements both on the material of the injector assembly and on its construction. At the same time, great forces have to be able to be absorbed by the injector assembly.

DE 102 20 931 C1 discloses an injector for injecting fuel into a combustion chamber of an internal combustion engine. The injector comprises an injector body, a nozzle needle and a control device, in order to control a pressure in a control space for actuating the nozzle needle. Furthermore, the injector comprises an inflow throttle and an outflow throttle which are hydraulically connected to the control space. The inflow throttle and the outflow throttle are arranged in a throttle module which is formed as a separate component and is sealed by means of cutting edges.

SUMMARY

According to various embodiments, an injector assembly and an injection valve can be provided, which injector assembly or injection valves makes reliable and precise operation possible and is configured in a spacesaving manner.

According to an embodiment, an injector assembly for an injection valve may have—an injector body with a central longitudinal axis and a recess with a fluid inlet,—a nozzle needle which is arranged axially movably in the recess in such a way that a fluid flow through at least one injection opening is prevented in a closed position of the nozzle needle and, otherwise, a fluid flow through the injection opening is released, and the nozzle needle has an end side which faces away from the injection opening,—a chamber which is formed in the injector body and adjoins an end side of the nozzle needle, which end side faces away from the injection opening,—a throttle module which is arranged in the chamber, a fluid feed chamber which is coupled hydraulically to the fluid inlet, a control space which is coupled hydraulically to the fluid feed chamber via an inflow throttle for setting a pressure force which can be applied to the pressure needle, and a valve chamber which is coupled hydraulically to the control space via an outflow throttle for receiving a valve which is configured for discharging fluid into a fluid return line being formed in the throttle module, and—a control module which is arranged in the chamber, is adjacent to the throttle module and in which the fluid return line is arranged, precisely one first and one second sealing edge being formed between the throttle module and the injector body and/or the control module, and a further hydraulic coupling of the fluid feed chamber to the control space being suppressed by means of the first sealing edge and a further hydraulic coupling of the fluid feed chamber to the valve chamber being suppressed by means of the second sealing edge, and a third sealing edge being formed between the injector body and the control module, by means of which third sealing edge a hydraulic coupling of the fluid feed chamber to the fluid return line is suppressed.

According to a further embodiment, the first and the second sealing edges can be formed on the throttle module. According to a further embodiment, the first sealing edge can be formed at an axial end of the throttle module, which axial end faces the nozzle needle, and the second sealing edge is formed at an axial end of the throttle module, which axial end faces away from the nozzle needle. According to a further embodiment, the first sealing edge can be formed on the injector body. According to a further embodiment, the second sealing edge can be formed on the control module. According to a further embodiment, the first and/or the second sealing edge can be formed as cutting edges.

According to another embodiment, an injection valve may have an actuator unit and an injector assembly as described above, wherein the actuator unit is coupled to the injector assembly in such a way that the injector assembly can be actuated by means of the actuator unit.

BRIEF DESCRIPTION OF THE DRAWINGS

Exemplary embodiments are explained in greater detail in the following text using the diagrammatic drawings, in which.

DETAILED DESCRIPTION

Figure 1:
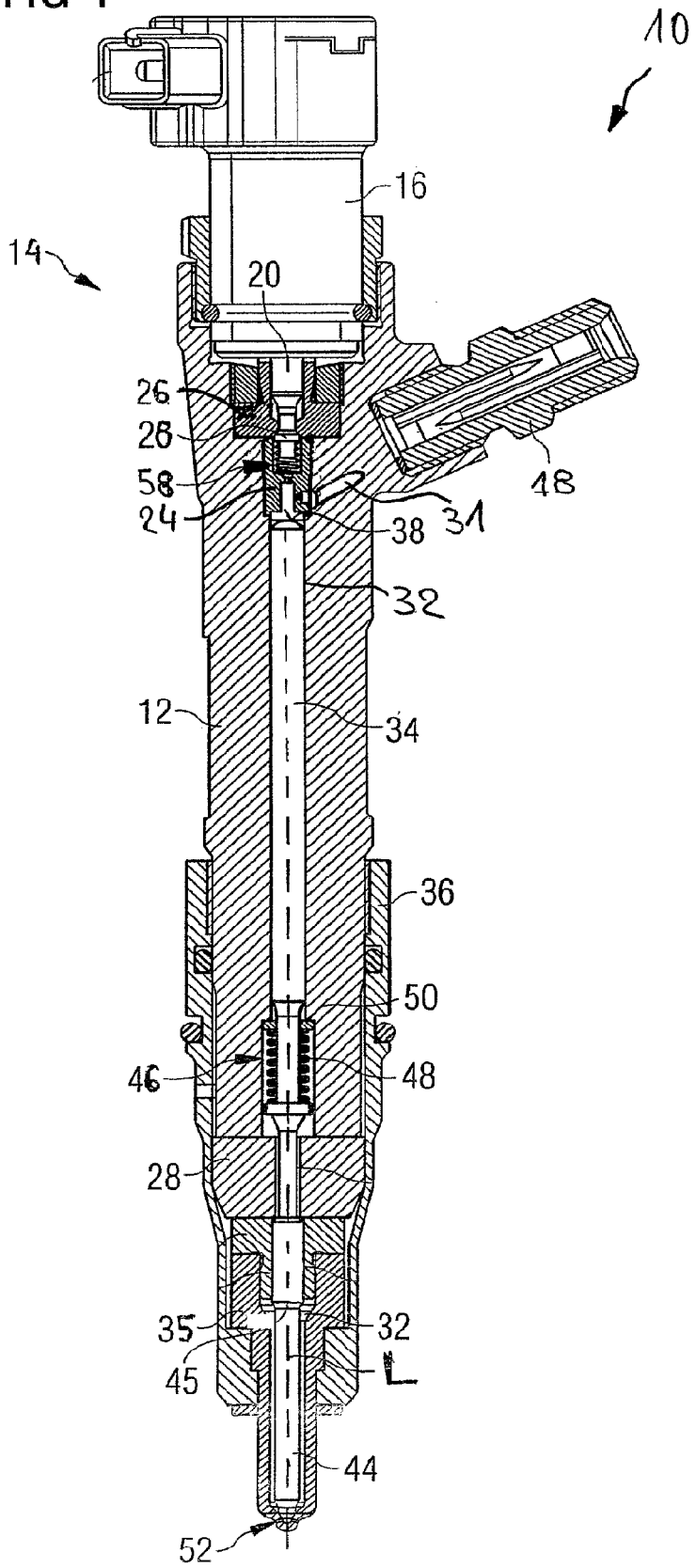
FIG. 1 shows a longitudinal section through an injection valve having an injector assembly.

According to one aspect, an injector assembly for an injection valve, has an injector body with a central longitudinal axis and a recess with a fluid inlet, a nozzle needle which is arranged axially movably in the recess in such a way that a fluid flow through at least one injection opening is prevented in a closed position and, otherwise, a fluid flow through the injection opening is released, and the nozzle needle has an end side which faces away from the injection opening, a chamber which is formed in the injector body and adjoins an end side of the nozzle needle, which end side faces away from the injection opening, a throttle module which is arranged in the chamber, a fluid feed chamber which is coupled hydraulically to the fluid inlet, a control space which is coupled hydraulically to the fluid feed chamber via an inflow throttle for setting a pressure force which can be applied to the nozzle needle, and a valve chamber which is coupled hydraulically to the control space via an outflow throttle for receiving a valve which is configured for discharging fluid into a fluid return line being formed in the throttle module, and a control module which is arranged in the chamber, is adjacent to the throttle module and in which the fluid return line is arranged. Precisely one first and one second sealing edge are formed between the throttle module and the injector body and/or the control module. A further hydraulic coupling of the fluid feed chamber to the control space is suppressed by means of the first sealing edge and a further hydraulic coupling of the fluid feed chamber to the valve chamber is suppressed by means of the second sealing edge. A third sealing edge is formed between the injector body and the control module, by means of which third sealing edge a hydraulic coupling of the fluid feed chamber to the fluid return line is suppressed.

Together with an actuator unit, the injector assembly can, for example, form the injection valve.

This has the advantage that the throttle module can achieve small dimensions. A small axial length of the throttle module and, as a consequence, a small axial extent of the injector assembly can therefore be achieved. Small recesses for the throttles in the throttle module are therefore also possible. Moreover, favorable flow conditions of the fluid in the throttle module and therefore low abrasion of the throttle module can also be achieved. Hardening of the throttle module can therefore be dispensed with. Moreover, as a result of the small number of sealing edges, high component strength and lower sensitivity of the throttle module to external mechanical influences can be achieved. The dimensions of the fluid feed chamber, the control space and the valve chamber can likewise be very small, as a result of which the machining outlay for these chambers can be very low. Overall, low costs can be achieved for the throttle module and therefore for the entire injector assembly.

In one embodiment, the sealing edges are formed on the throttle module. Simple production of the sealing edges is therefore possible. The throttle module is not overdetermined with regard to its sealing edges.

In a further embodiment, one of the sealing edges is formed at an axial end of the throttle module, which axial end faces the nozzle needle, and the other of the sealing edges is formed at an axial end of the throttle module, which axial end faces away from the nozzle needle. A simple formation of the throttle module is therefore possible.

In a further embodiment, the first sealing edge is formed on the injector body and/or the second sealing edge is formed on the control module. Simple production of the sealing edges is therefore possible.

In a further embodiment, the sealing edges are formed as cutting edges. Particularly satisfactory sealing properties of the sealing edges can therefore be achieved.

According to a second aspect, an injection valve may have an actuator unit and an injector assembly according to the first aspect. The actuator unit is coupled to the injector assembly in such a way that the injector assembly can be actuated by means of the actuator unit.

FIG. 1 shows an injection valve 10 having an injector assembly 14 and an actuator unit 16.

The injector assembly 14 has an injector body 12 with a central longitudinal axis L and a recess 32. The injector body can be configured in one piece or in multiple pieces. A nozzle needle 34 is arranged in the recess 32 of the injector body 12. The nozzle needle 34 can be configured in one piece or in multiple pieces.

The actuator unit 16 is arranged in the injector body 12. The actuator unit 16 can be configured, in particular, as a piezoelectric actuator with a stack of piezoelectric elements, and its axial extent changes as a function of the electric voltage which is applied. The electric voltage is applied to the actuator unit via a connector socket. The actuator unit 16 is connected to a transmission means 20 which is likewise arranged in the injector body 12. The actuator unit 16 and the transmission means 20 form an actuating drive for the nozzle needle 34.

Furthermore, the injector body 12 comprises a high pressure connection 18, via which, in the mounted state, the injection valve 10 is connected to a high pressure circuit (not shown) of a fluid.

A chamber 22 is arranged in the recess 32 of the injector body 12. The connection between the high pressure connection 18 and the chamber 22 takes place via a fluid inlet 23. A throttle module 24 and a control module 26 are arranged in the chamber 22, the structure and function of which modules 24, 26 will be described in detail further below. A valve 28 which is coupled to the transmission means 20 and has a valve body 29 and a valve spring 30 is arranged in the throttle module 24 and the control module 26. Depending on the form of the valve body 29, the valve 28 can also be configured without a valve spring 30 in further embodiments (not shown). This applies, in particular, when the valve body 29 is configured as a ball. If the valve 28 is configured without a valve spring 30, the throttle module 24 can be of very small configuration.

Fluid return lines 31 which make a hydraulic connection possible to a tank (not shown) of the vehicle are arranged in the control module 26. Depending on the position of the valve 28, the chamber 22 is coupled hydraulically to the fluid return lines 31 or is decoupled hydraulically from the latter.

Furthermore, the injection valve 10 comprises a nozzle body 35 which is connected to the injector body 12 by means of a nozzle clamping nut 36. One or more injection openings 52 is/are arranged in the nozzle body 35 at the end which faces away from the actuator unit 16.

The nozzle needle 34 has an end side 38 which faces the chamber 22. In its region which faces the at least one injection opening 52, the nozzle needle 34 has a shaft section 44. At its end which faces the actuator unit 16, the shaft section 44 of the nozzle needle 34 has a nozzle needle shoulder 45 which is in contact with fluid which is at approximately the pressure of the high pressure circuit. The nozzle needle shoulder 45 is configured in such a way that the force which is caused by the pressure of the fluid has an opening action on the nozzle needle 34.

Furthermore, a cavity 46 is formed in the injector body 12, which cavity 46 receives a nozzle spring 48 which is supported at one end on a shoulder 50 of the cavity 46 and at the other end prestresses the nozzle needle 34 in such a way that the latter assumes a closed position which is assigned to it and in which it suppresses the fluid flow through the at least one injection opening 52 which is arranged in the nozzle body 35.

The nozzle needle position depends on the balance of the forces which, caused by the pressure of the fluid, act on the nozzle needle shoulder 45 and on the tip of the nozzle needle 34, and secondly on the spring force of the nozzle spring 48 and the force as a result of the fluid which is situated in the chamber 22 and the force which is caused as a result and is introduced via the end side 38 of the nozzle needle 34 in the closing direction of the nozzle needle 34.

Figure 2:
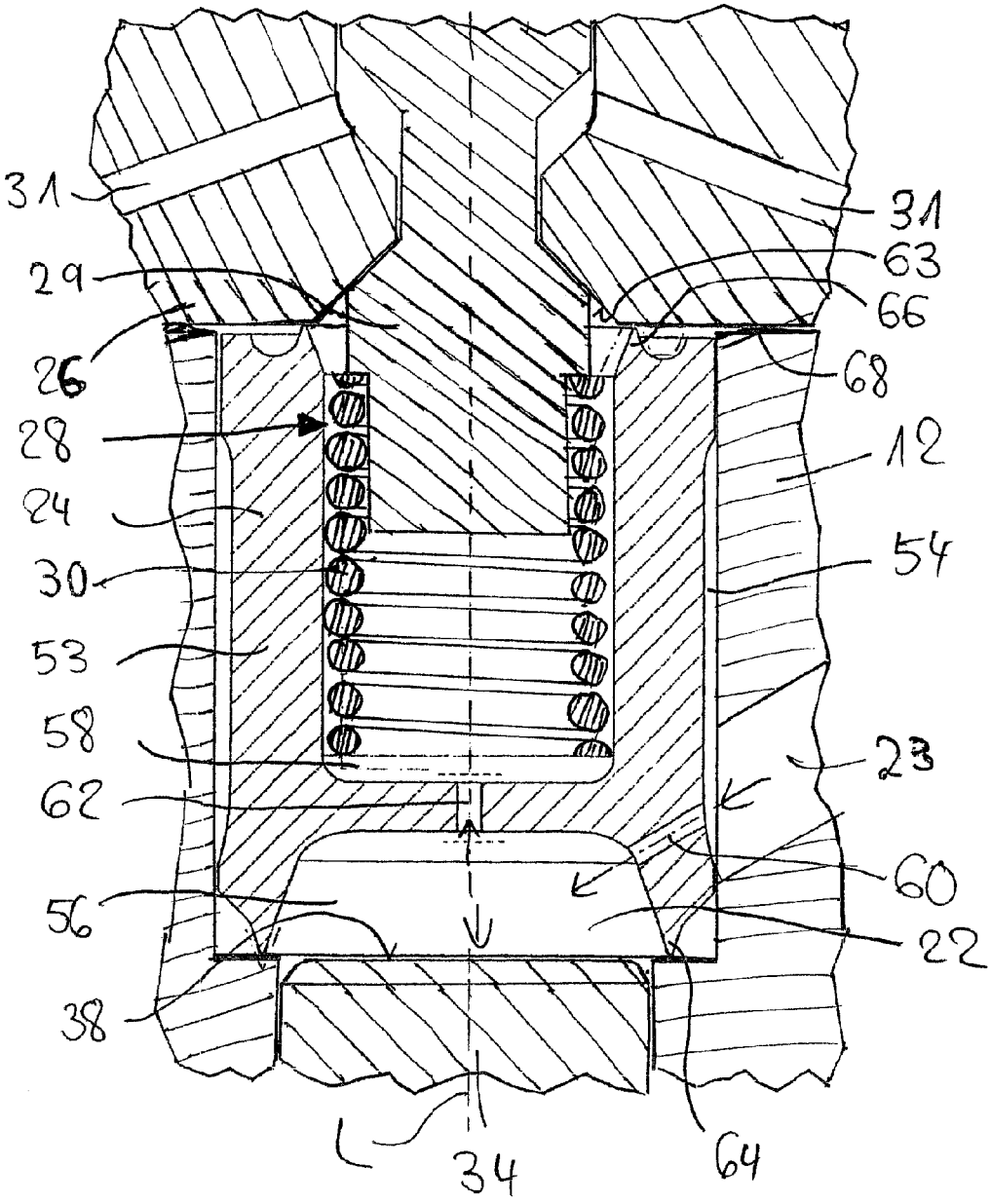
FIG. 2 shows a detailed view of the injector assembly in a longitudinal section.

As is shown in FIG. 2, the throttle module 24 is of substantially cylindrical configuration with a module body 53 and extends in the direction of the longitudinal axis L in the chamber 22 of the injector body 12.

A fluid feed chamber 54 is formed in the throttle module 24, which fluid feed chamber 54 is arranged as an annular gap between the body of the throttle module 24 and the injector body 12 and is coupled hydraulically to the fluid inlet 23.

At its end which faces the end side 38 of the nozzle needle 34, the throttle module 24 has a control space 56 which forms a part of the chamber 22, and via which control space 56 a pressure force can be applied to the nozzle needle 34 by means of the fluid, by means of which pressure force a fluid flow through the at least one injection opening 52 is prevented in the closed position of the nozzle needle 34 and, otherwise, a fluid flow through the at least one injection opening 52 is released.

Facing the control module 26, a valve chamber 58 is formed in the throttle module 24, in which valve chamber 58 at least part of the valve body 29 and the valve spring 30 of the valve 28 are arranged.

The fluid feed chamber 54 is connected hydraulically to the control space 56 via an inflow throttle 60. Furthermore, an outflow throttle 62 is arranged in the module body 53 of the throttle module 24 between the control space 56 and the valve chamber 58, by which outflow throttle 62 the control space 56 is coupled hydraulically to the valve chamber 58.

The valve 28, in particular the valve body 29, can be actuated via the actuator unit 60, and can close or open a sealing seat 63 which is formed on the control module 26. The valve body 29 is restored by means of the valve spring 30 which is configured as a helical spring. In the further embodiments, in which the valve 28 is configured without a valve spring 30, the valve body 29 is restored by means of a hydraulic force which acts on it.

A first sealing edge 64 is formed between the throttle module 24 and the injector body 12, to be precise at an axial end of the throttle module 24, which axial end faces the nozzle needle 34.

A further hydraulic coupling between the fluid feed chamber 54 which is configured as an annular gap and the control space 56 can thus be prevented, as a result of which it is possible to fix the fluid feed into the control space 56 via the dimensioning of the inflow throttle 60 and therefore, when the valve 28 is closed, to fix the pressure rise in the control space 56. The first sealing edge 64 is preferably configured as a cutting edge, since a particularly satisfactory sealing action can therefore be achieved between the throttle module 24 and the injector body 12.

A second sealing edge 66 is formed between the throttle module and the control module 26. The sealing edge 66 is preferably arranged at an axial end of the throttle module 24, which axial end faces away from the nozzle needle 34. A further hydraulic coupling between the fluid feed chamber 54 and the valve chamber 58 can be prevented by means of the second sealing edge 66. This is of significance, in particular, when the valve 28 is open, that is to say the valve body 29 is raised up from the sealing seat 63. In this case, unintended outflow of the fluid from the fluid feed chamber 54 via the valve chamber 58 to the fluid return line 31 can be avoided by means of the second sealing edge 66.

A third sealing edge 68 is formed between the injector body 12 and the control module 26. A direct hydraulic coupling of the fluid feed chamber 54 to the fluid return line 31 can be suppressed by means of the third sealing edge 68.

As a result of the formation of the first sealing edge 64 at the axial end of the throttle module 24, which axial end faces the nozzle needle 34, and the formation of the second sealing edge 66 at the axial end of the throttle module 24, which axial end faces away from the nozzle needle 34, it is possible to firstly configure the throttle module 24 very simply, since, in particular, simple production of the sealing edges 64, 66 is possible. Secondly, the throttle module 24 is not overdetermined with regard to its sealing edges 64, 66. Relatively high tolerances can therefore be permitted during the production of the throttle module 24, in particular with regard to the tolerances for the sealing edges 64, 66. Moreover, the simple cylindrical configuration of the throttle module 24 permits small dimensions of the throttle module 24 and high component strength. As a result of a small axial extent of the throttle module 24 and therefore a small axial extent of the injector assembly 14, a small axial extent of the entire injection valve 10 becomes possible. Moreover, it is possible for the favorable arrangement in flow terms, in particular, of the inflow throttle 60 and the outflow throttle 62 to achieve a situation where only a low eddy formation of the fluid in the control space 56 and therefore low abrasive wear of the module body 53 of the throttle module 24 take place. Hardening of the throttle module 24 can therefore be dispensed with.

Satisfactory sealing properties of the sealing edges are possible as a result of the configuration of the sealing edges 64, 66 as cutting edges.

In the following text, the function of the injection valve 10 is to be described briefly:

By activation of the actuator unit 16 which is configured as a piezoelectric actuator, the actuator unit 16 extends and the valve body 29 is raised up from the sealing seat 63 on the control module 26 via the transmission means 20. A hydraulic connection from the control space 56 via the valve chamber 58 to the fluid return line 31 is therefore released and the pressure in the control space 56 drops. The equilibrium of forces at the nozzle needle 34 is therefore changed in such a way that the nozzle needle 34 moves into the control space 56 in the direction of the actuator unit 16, as a result of which the at least one injection opening 52 in the nozzle body 35 is released. If the injection valve 10 is configured as a fuel injection valve, an injection of fuel into a combustion chamber of an internal combustion engine can therefore take place.

As soon as the injection is to be ended, the actuator unit 16 is deactivated, as a result of which the valve body 29 comes into contact again with the sealing seat 63 in the control module 26. The hydraulic coupling between the control space 56 and the fluid return line 31 is therefore interrupted. As a result of the feed of fluid from the fluid inlet 23 via the fluid feed chamber 54 and the inflow throttle 60 into the control space 56, the pressure in the control space 56 rises, as a result of which the valve needle 34, optionally with the assistance of the nozzle spring 48, is moved away from the actuator unit 16 in the axial direction. The nozzle needle 34 therefore passes into a closed position and the fluid flow through the at least one injection opening 52 is suppressed. The assistance of the nozzle spring 48 for closing the nozzle needle 34 is of significance, in particular, during the starting phase of the internal combustion engine and with regard to an increased functional reliability of the closing operation of the nozzle needle 34.

As a result of the formation of the first and second sealing edges 62, 64 on the throttle module 24, reliable control of the fluid from the fluid feed chamber 54 to the control space 56 and from the control space 56 via the valve chamber 58 to the fluid return line 31 can be achieved, in particular.

In further embodiments which are not shown here in detail, it is also possible to form the first sealing edge 64 in the injector body 12 instead of in the throttle module 24, the second sealing edge in the control module 26 instead of in the throttle module 24, and the third sealing edge 68 in the control module 26 instead of in the injector body 12.

The invention claimed is:

1. An injector assembly for an injection valve comprising:

an injector body with a central longitudinal axis and a recess with a fluid inlet, a nozzle needle arranged axially movably in the recess in such a way that a fluid flow through at least one injection opening is prevented in a closed position of the nozzle needle and, otherwise, a fluid flow through the injection opening is released, and the nozzle needle has an end side which faces away from the injection opening, a chamber formed in the injector body and defined in part by the end side of the nozzle needle facing away from the injection opening, and a cylindrical recess formed in the injector body, a throttle module arranged in the chamber, a fluid feed chamber coupled hydraulically to the fluid inlet, a control space coupled hydraulically to the fluid feed chamber via an inflow throttle for setting a pressure force which can be applied to the nozzle needle, and a valve chamber coupled hydraulically to the control space via an outflow throttle for receiving a valve configured for discharging fluid into a fluid return line, and a control module arranged in the chamber and adjacent to the throttle module, wherein the fluid return line is formed in the control module, exactly one first sealing edge between the throttle module and the injector body, the first sealing edge suppressing a hydraulic coupling of the fluid feed chamber to the control space, exactly one second sealing edge between the throttle module and the control module, the second sealing edge suppressing a hydraulic coupling of the fluid feed chamber to the valve chamber, and a third sealing edge formed between the injector body and the control module, the third sealing edge suppressing a hydraulic coupling of the fluid feed chamber to the fluid return line;

wherein the throttle module has an axial length, and wherein the throttle module is received along the full axial length in the cylindrical recess formed in the injector body, the cylindrical recess having a constant diameter along the full axial length of the throttle module.

2. The injector assembly according to claim 1, wherein the first and the second sealing edges are farmed on the throttle module.

3. The injector assembly according to claim 1, wherein the first sealing edge is formed at an axial end of the throttle module facing the nozzle needle, and the second sealing edge is formed at an axial end of the throttle module facing away from the nozzle needle.

4. The injector assembly according to claim 1, wherein at least one of the first and the second sealing edge are formed as cutting edges.

5. The injector assembly according to claim 1, wherein the exactly one first sealing edge and exactly one second sealing edge define the only sealing edges of the throttle module with any other structure of the injector assembly.

6. An injection valve having an actuator unit and an injector assembly, the actuator unit being coupled to the injector assembly in such a way that the injector assembly can be actuated by means of the actuator unit, wherein the assembly unit comprises:

an injector body with a central longitudinal axis and a recess with a fluid inlet, a nozzle needle arranged axially movably in the recess in such a way that a fluid flow through at least one injection opening is prevented in a closed position of the nozzle needle and, otherwise, a flui flow through the injection opening is released, and the nozzle needle has an end side which faces away from the injection opening, a chamber formed in the injector body and defined in part by the end side of the nozzle needle facing away from the injection opening, and a cylindrical recess formed in the injector body, a throttle module arranged in the chamber, a fluid feed chamber coupled hydraulically to the fluid inlet, a control space coupled hydraulically to the fluid feed chamber via an inflow throttle for setting a pressure force which can be applied to the nozzle needle, and a valve chamber coupled hydraulically to the control space via an outflow throttle for receiving a valve chamber coupled hydraulically to the control space via an outflow throttle for receiving a valve configured for discharging fluid into a fluid return line, and a control module arranged in the chamber and adjacent to the throttle module, wherein the fluid return line is formed in the control module, exactly one first sealing edge between the throttle module and the injector body, the first sealing edge suppressing a hydraulic coupling of the fluid feed chamber to the control space, exactly one second sealing edge between the throttle module and the control module, the second sealing edge suppressing a hydraulic coupling of the fluid feed chamber to a valve chamber, and a third sealing edge formed between the injector body and the control module, the third sealing edge suppressing a hydraulic coupling of the fluid feed chamber to the fluid return line;

wherein the throttle module has an axial length, and wherein the throttle module is received along the full axial length in the cylindrical recess formed in the injector body, the cylindrical recess having a constant diameter along the full axial length of the throttle module.

7. The injection valve according to claim 6, wherein the first and the second sealing edges are formed on the throttle module.

8. The injection valve according to claim 6, wherein the first sealing edge is formed at an axial end of the throttle module facing the nozzle needle, and the second sealing edge is formed at an axial end of the throttle module facing away from the nozzle needle.

9. The injection valve according to claim 6, wherein at least one of the first and the second sealing edge are formed as cutting edges.

10. The injection valve according to claim 6, wherein the exactly one first sealing edge and exactly one second sealing edge define the only sealing edges of the throttle module with any other structure of the injector assembly.

11. An injector assembly for an injection valve, having an injector body with a central longitudinal axis and a recess with a fluid inlet, a nozzle needle arranged axially movably in the recess having an end side which faces away from an injection opening, a chamber formed in the injector body and defined in part by the end side of the nozzle needle facing away from the injection opening, and a cylindrical recess formed in the injector body, a throttle module arranged in the chamber, a fluid feed chamber coupled hydraulically to the fluid inlet, a control space coupled hydraulically to the fluid feed chamber via an inflow throttle, and a valve chamber coupled hydraulically to the control space via an outflow throttle for receiving a valve configured for discharging fluid into a fluid return, and a control module arranged in the chamber and adjacent to the throttle module, wherein the fluid return line is formed in the control module, exactly one first sealing edge between the throttle module and the injector body, the first sealing edge suppressing a hydraulic coupling of the fluid feed chamber to the control space, exactly one second sealing edge between the throttle module and the control module, the second sealing edge suppressing a hydraulic coupling of the fluid feed chamber to the valve chamber, and a third sealing edge formed between the injector body and the control module, the third sealing edge suppressing a hydraulic coupling of the fluid feed chamber to the return line;

wherein the throttle module has an axial length, and wherein the throttle module is received along the full axial length in a the cylindrical recess formed in the injector body, the cylindrical recess having a constant diameter along the full axial length of the throttle module.

12. The injector assembly according to claim 11, wherein the first and the second sealing edges is formed on the throttle module.

13. The injector assembly according to claim 11, wherein the first sealing edge is formed at an axial end of the throttle module facing the nozzle needle, and the second sealing edge is formed at an axial end of the throttle module facing away from the nozzle needle.

14. The injector assembly according to claim 11, wherein at least one of the first and the second sealing edge are formed as cutting edges.

15. The injector assembly according to claim 11, wherein the exactly one first sealing edge and exactly one second sealing edge define the only sealing edges of the throttle module with any other structure of the injector assembly.

* * * * *